US009436129B2

(12) United States Patent
Kusukawa

(10) Patent No.: US 9,436,129 B2
(45) Date of Patent: Sep. 6, 2016

(54) DRIVE TRANSMISSION MECHANISM AND IMAGE FORMING APPARATUS WITH THE SAME

(71) Applicant: KYOCERA Document Solutions Inc., Osaka (JP)

(72) Inventor: Takashi Kusukawa, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/800,149

(22) Filed: Jul. 15, 2015

(65) Prior Publication Data

US 2016/0017975 A1 Jan. 21, 2016

(30) Foreign Application Priority Data

Jul. 17, 2014 (JP) ..... 2014-146408

(51) Int. Cl.

| | |
|---|---|
| ***G03G 15/08*** | (2006.01) |
| ***G03G 21/16*** | (2006.01) |
| *G03G 15/00* | (2006.01) |
| *G03G 21/18* | (2006.01) |

(52) U.S. Cl.

CPC ..... *G03G 15/0889* (2013.01); *G03G 21/1647* (2013.01); *G03G 15/757* (2013.01); *G03G 21/1857* (2013.01); *G03G 2215/0132* (2013.01)

(58) Field of Classification Search

USPC ..... 399/119

See application file for complete search history.

(56) References Cited

U.S. PATENT DOCUMENTS

| | | | | |
|---|---|---|---|---|
| 6,473,580 | B1 * | 10/2002 | Inomata | F16D 1/112 399/111 |
| 6,839,532 | B2 * | 1/2005 | Hoashi | G03G 15/0131 399/167 |
| 7,664,431 | B2 * | 2/2010 | Jang | G03G 15/757 399/167 |
| 8,295,734 | B2 * | 10/2012 | Ueno | G03G 15/757 399/167 |
| 8,437,669 | B2 * | 5/2013 | Morioka | F16D 1/10 399/111 |
| 9,213,306 | B2 * | 12/2015 | Morioka | G03G 21/1825 |

FOREIGN PATENT DOCUMENTS

JP 2005-017758 A 1/2005

* cited by examiner

*Primary Examiner* — Minh Phan
*Assistant Examiner* — Linda B Smith

(57) ABSTRACT

A drive-side coupling part of a drive transmission mechanism includes: a base including a first opposed surface facing a driven-side coupling part of the drive transmission mechanism in an attached state; a semispherical projection from the first opposed surface at a rotational center of the drive-side coupling part; and a cylindrical projection including an arcuate first projection centered on the rotational center, an arcuate second projection having a shorter inside diameter than the first projection, and a stepped portion between the first and second projections. The driven-side coupling part includes: a base including a second opposed surface facing the drive-side coupling part in the attached state; a columnar projection from the second opposed surface at a rotational center of the driven-side coupling part; a radially-extended peripheral projection on a periphery of the columnar projection; and a recess depressed from a top surface of the columnar projection at the rotational center.

4 Claims, 6 Drawing Sheets

DRIVE TRANSMISSION MECHANISM AND IMAGE FORMING APPARATUS WITH THE SAME

INCORPORATION BY REFERENCE

This application claims priority to Japanese Patent Application No. 2014-146408 filed on Jul. 17, 2014, the entire disclosure of which are incorporated herein by reference.

BACKGROUND

The present disclosure relates to a drive transmission mechanism and an image forming apparatus with the same and particularly relates to a technique for transmitting a driving force to a removable unit, such as a developing device, attachable to and removable from the image forming apparatus.

In some image forming apparatuses, a developing device, a photoconductor device, and/or other process units are mounted removably on an apparatus body. By changing the combination of the apparatus body and the process unit, various image forming apparatuses can be produced which achieve various capabilities, for example, different numbers of print pages per unit time (PPM: pages per minute) or different numbers of copies per unit time (CPM: copies per minute).

In order to removably mount the process unit as described above, what is essential is a drive transmission mechanism for transmitting a driving force from a drive mechanism contained in the apparatus body to the process unit. Such a drive transmission mechanism generally employs a coupling structure configured to transmit a driving force from the drive mechanism to the process unit by mating a drive-side coupling part provided on the apparatus body side with a driven-side coupling part provided on the process unit side.

SUMMARY

A technique improved over the above technique is proposed herein as one aspect of the present disclosure.

A drive transmission mechanism according to an aspect of the present disclosure includes a drive unit and a removable unit. The drive unit includes a drive section and a drive-side coupling part to which a rotary driving force of the drive section is to be transmitted. The removable unit is a unit attachable to and removable from the drive unit and includes: a cover part having a circular opening formed in a portion of an outside surface thereof; a driven-side coupling part provided within the opening and mating with the drive-side coupling part in an attached state where the removable unit is attached to the drive unit; and a driven section capable of being driven by the rotary driving force transmitted from the drive-side coupling part to the driven-side coupling part. The drive-side coupling part includes: a first base including a first opposed surface facing the driven-side coupling part in the attached state; a semispherical projection raised from the first opposed surface at a rotational center of the drive-side coupling part; and a cylindrical projection including a first projection of an arcuate pillar shape centered on the rotational center of the drive-side coupling part, a second projection of an arcuate pillar shape having a shorter inside diameter than an inside diameter of the first projection, and a stepped portion provided between the first projection and the second projection. The driven-side coupling part includes: a second base including a second opposed surface facing the drive-side coupling part in the attached state; a columnar projection raised from the second opposed surface at a rotational center of the driven-side coupling part; a peripheral projection raised radially from an outer periphery of the columnar projection; and a recess depressed from a top surface of the columnar projection at the rotational center of the driven-side coupling part.

An image forming apparatus according to another aspect of the present disclosure includes the above-described drive transmission mechanism. Furthermore, the removable unit is a developing device including as the driven sections an agitating roller capable of agitating a developer and a developing roller capable of supplying the developer to an image carrier.

DETAILED DESCRIPTION

Figure 1:
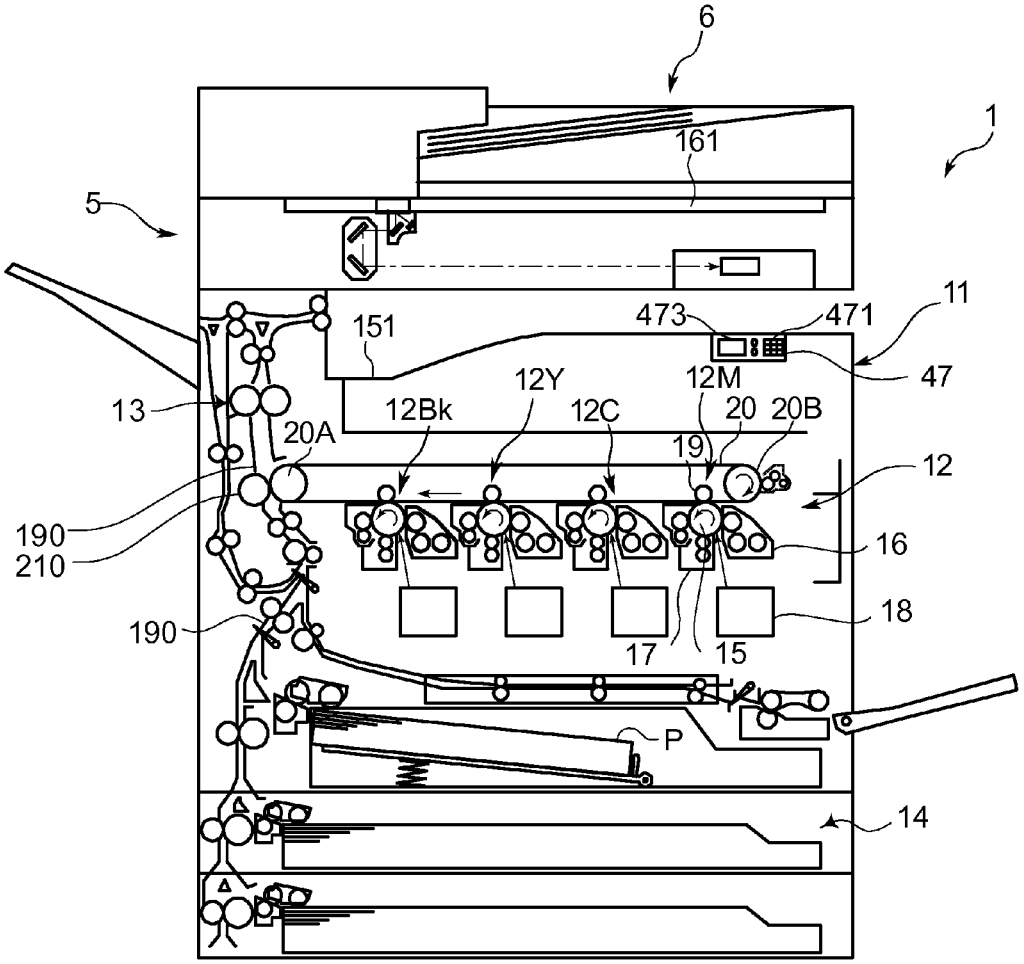
FIG. 1 is a view showing the structure of an image forming apparatus including a drive transmission mechanism according to one embodiment of the present disclosure.

Hereinafter, a description will be given of a drive transmission mechanism according to one embodiment of the present disclosure and an image forming apparatus with the drive transmission mechanism with reference to the drawings. FIG. 1 is a cross-sectional view showing the structure of the image forming apparatus including the drive transmission mechanism according to the one embodiment of the present disclosure.

The image forming apparatus 1 is a multifunction peripheral having multiple functions such as, for example, a copy function, a print function, a scan function, and a facsimile function. The image forming apparatus 1 is made up so that a housing 11 thereof includes an operating section 47, an image forming section 12, a fixing section 13, a sheet feed section 14, a document feed section 6, a document reading section 5, and so on.

The operating section 47 includes an operating key section 471 and a display 473 formed of a liquid crystal display or the like and is configured to receive, based on a user's operation entered through the operating key section 471 and so on, commands for various types of operations and processing executable by the image forming apparatus 1.

When the operating section 47 receives a command to read an original document, the document reading section 5 optically reads an image of an original document being fed from the document feed section 6 or an image of an original document placed on an original glass plate 161 to generate image data. The image data generated by the document reading section 5 is stored on an internal HDD, a network-connected computer or the like.

When the operating section 47 receives a command to form an image, the image forming section 12 forms a toner image on a recording paper sheet P fed from the sheet feed section 14, based on image data generated by the above document reading operation, image data stored on the internal HDD or other image data.

Each of an image forming unit 12M for magenta, an image forming unit 12C for cyan, an image forming unit 12Y for yellow, and an image forming unit 12Bk for black in the image forming section 12 includes a photosensitive drum (image carrier) 15, a developing device 16, a charging device 17, an exposure device 18, and a primary transfer roller 19.

In performing color printing, the image forming units 12M, 12C, 12Y, and 12Bk form respective toner images on their respective photosensitive drums 15 through charging, exposure, and developing processes based on respective images of respective different color components constituting the image data and then allow their respective primary transfer rollers 19 to transfer the toner images to an intermediate transfer belt 20 mounted around a drive roller 20A and a driven roller 20B.

The toner images of different colors transferred to the intermediate transfer belt 20 are superposed each other on the intermediate transfer belt 20 by controlling their transfer timings, resulting in a multicolor toner image. A secondary transfer roller 210 is configured to transfer the multicolor toner image formed on the surface of the intermediate transfer belt 20, at a nip between the secondary transfer roller 210 and the drive roller 20A with the intermediate transfer belt 20 in between, to a recording paper sheet P conveyed from the sheet feed section 14 along a conveyance path 190. Thereafter, the fixing section 13 fixes the toner image on the recording paper sheet P by heat fixing. The recording paper sheet P having a multicolor image fixed thereon by the completion of the fixing is discharged to a sheet output tray 151.

Figure 2:
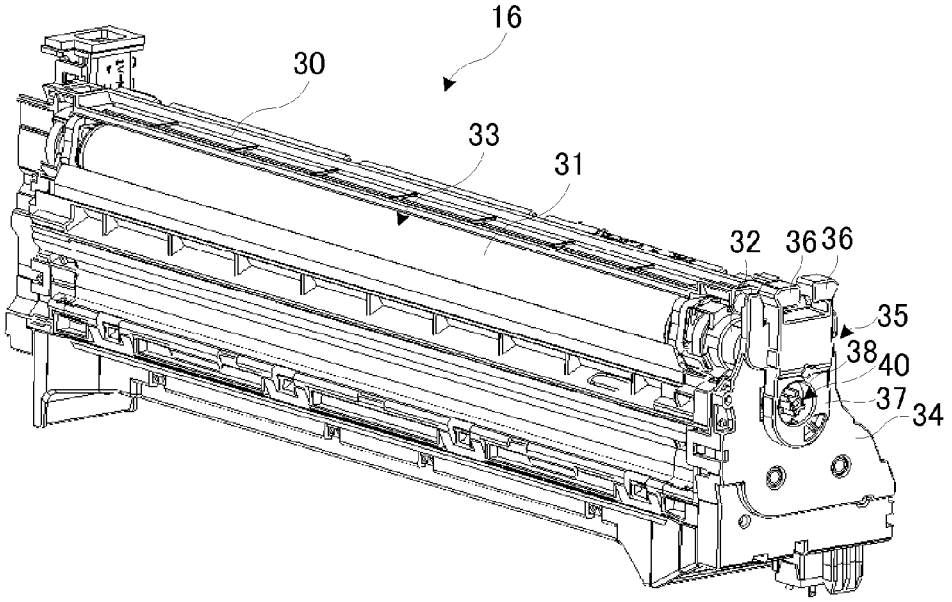
FIG. 2 is a perspective view showing a developing device in the one embodiment of the present disclosure.

FIG. 2 is a perspective view showing the developing device 16 in the one embodiment of the present disclosure. The developing device 16 includes a developing roller 31 (driven section), a magnet roller (not shown), and an agitating screw (not shown) which are contained in the housing 30.

The housing 30 contains a developer. The developer agitated in the housing 30 by the agitating screw is picked up by the magnet roller. Thereafter, the toner contained in the developer moves onto the peripheral surface of the developing roller 31 by a magnetic field formed between the magnet roller and the developing roller 31. A rotary shaft 32 of the developing roller 31 is rotatably journaled in the housing 30. In this state, a portion of the peripheral surface of the developing roller 31 is exposed through an opening 33 in the housing 30 and faces the photosensitive drum 15. The toner having moved to the peripheral surface of the developing roller 31 is attracted by an electrostatic latent image formed on the peripheral surface of the photosensitive drum 15 to move toward the peripheral surface of the photosensitive drum 15.

Meanwhile, the developing device 16 is configured to be attachable to and removable from an apparatus body 50 (see FIG. 3) of the image forming apparatus 1. The apparatus body 50 contains, besides the previously described components including the fixing section 13 and the sheet feed section 14, a drive section (not shown) formed of a motor or the like, a power supply section (not shown) configured to supply electric power to the drive section, a control section (not shown) formed of a CPU (central processing unit) for controlling a driving operation of the drive section, and so on and functions as a drive unit configured to drive process units, such as the developing device 16 and the photosensitive drum 15.

A side surface 34 of the housing 30 of the developing device 16 is provided with a mating part 35 mateable with a supporting part 51 (see FIG. 3) of the apparatus body 50. The mating part 35 mates with the supporting part 51 in an attached state where the developing device 16 is attached to the apparatus body 50. At this time, two projections 36 provided on the mating part 35 are engaged by locking pawls 52 (see FIG. 3) of the supporting part 51. Thus, the developing device 16 is prevented from getting out of the apparatus body 50.

The side surface 34 of the housing 30 is further provided with a cover part 37 whose outside surface has a circular opening 38 formed therein. A driven-side coupling part 40 is provided within the opening 38. The driven-side coupling part 40 mates with a drive-side coupling part 60 (see FIG. 3) of the apparatus body 50 in the attached state where the developing device 16 is attached to the apparatus body 50.

The driven-side coupling part 40 is configured so that when mating with the drive-side coupling part 60, a rotary driving force can be transmitted thereto from the drive-side coupling part 60. A base 41 (see FIG. 5) of the driven-side coupling part 40 is connected through unshown gears or the like to the rotary shaft 32 of the developing roller 31 and the rotary shaft of the agitating roller and is capable of transmitting a rotary driving force through the gears or the like to the developing roller 31 and the agitating roller.

Figure 3:
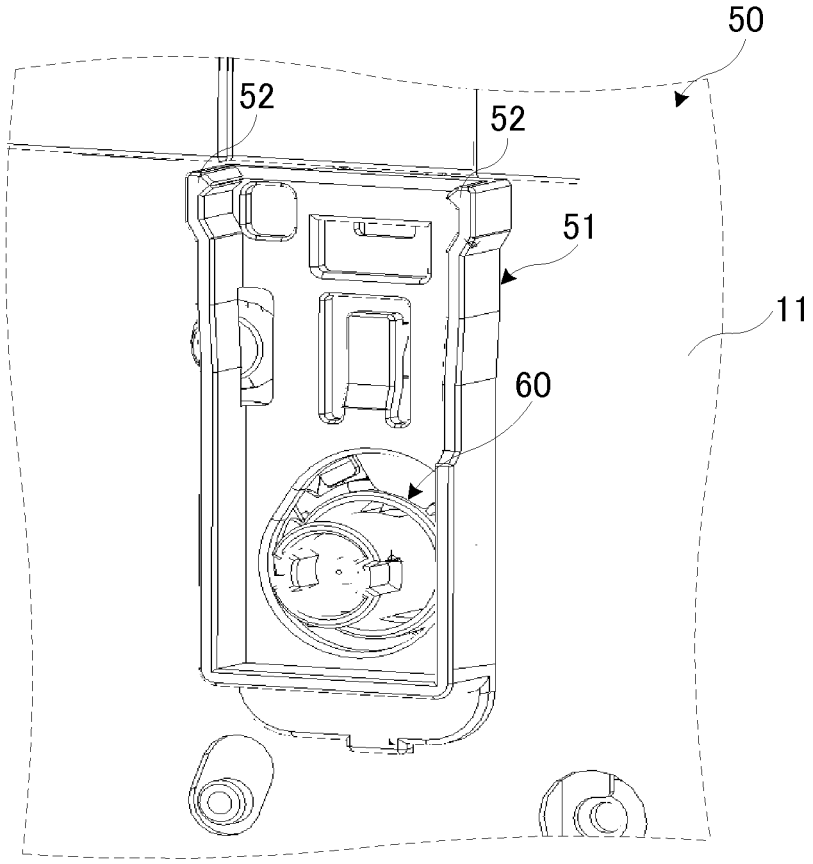
FIG. 3 is a perspective view showing a supporting part and a drive-side coupling part both of which are provided on an apparatus body in the one embodiment of the present disclosure.
Figure 4:
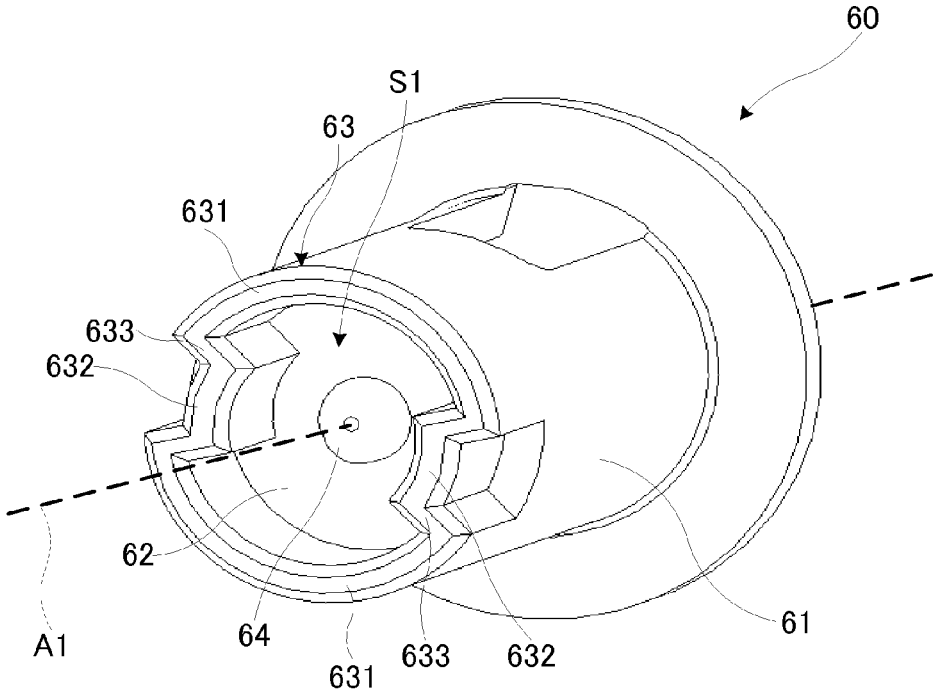
FIG. 4 is a view showing the structure of the drive-side coupling part in the one embodiment of the present disclosure.

FIG. 3 is a perspective view showing the supporting part 51 and the drive-side coupling part 60 which are provided on the apparatus body 50 in the one embodiment of the present disclosure. FIG. 4 is a view showing the structure of the drive-side coupling part 60 in the one embodiment of the present disclosure.

A base 61 of the drive-side coupling part 60 is a columnar member and is connected through an unshown gear or the like to the drive section contained in the apparatus body 50. A rotary driving force of the drive section is transmitted through the gear or the like to the base 61, so that the base 61 rotates about a rotational center A1. The central axis of the columnar shape of the base 61 coincides with the rotational center A1.

A top surface 62 (opposed surface) of the base 61 faces the driven-side coupling part 40 in the attached state where the developing device 16 is attached to the apparatus body 50. The top surface 62 has a cylindrical projection 63 and a semispherical projection 64 both formed to extend upward from the top surface 62.

The cylindrical projection 63 is a cylindrical member formed at a radially distal edge of the top surface 62 of the base 61. The cylindrical projection 63 includes: first projections 631 and second projections 632 all of which have an arcuate pillar shape centered on the rotational center A1; and stepped portions 633 provided between adjacent first and second projections 631 and 632. The first projections 631 and the second projections 632 are formed alternately in the circumferential direction.

The inside diameter of the second projections 632 is set smaller than the inside diameter of the first projections 631. Furthermore, the outside diameter of the second projections 632 is set smaller than the outside diameter of the first projections 631. Each stepped portion 633 is a member having a pillar shape extending in a radial direction and is located between the adjacent first and second projections 631, 632 having different diameters to connect the adjacent first and second projections 631, 632. The stepped portions 633 are engageable against after-mentioned peripheral projections 44 of the driven-side coupling part 40 to function as driving force transmitting portions transmitting a rotary driving force of the drive section to the peripheral projections 44.

The semispherical projection 64 is a member having a semispherical shape centered on the rotational center A1. The outside diameter of the semispherical projection 64 is set smaller than the inside diameters of the first and second projections 631, 632 and the semispherical projection 64 is surrounded by the cylindrical projection 63. The above-described cylindrical projection 63 and semispherical projection 64 define a space S1 surrounded by the cylindrical projection 63, the semispherical projection 64, and the top surface 62.

Figure 5:
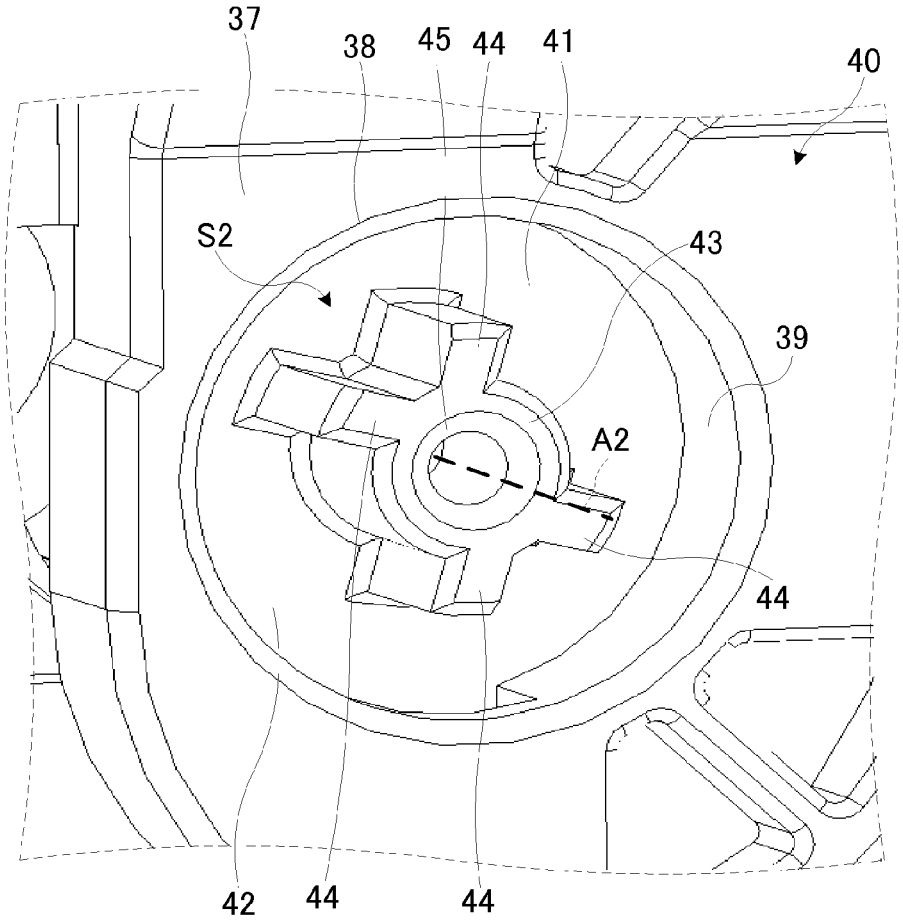
FIG. 5 is a view showing the structure of a driven-side coupling part in the one embodiment of the present disclosure.

FIG. 5 is a view showing the structure of the driven-side coupling part 40 in the one embodiment of the present disclosure. The base 41 of the driven-side coupling part 40 is supported rotatably about a rotational center A2 by the housing 30. The rotational center A2 coincides with the center of the opening 38.

A top surface 42 (opposed surface) of the base 41 faces the drive-side coupling part 60 in the attached state where the developing device 16 is attached to the apparatus body 50. The top surface 42 has a columnar projection 43 and a plurality of peripheral projections 44 all of which are formed to extend upward from the top surface 42. The columnar projection 43 is a member having a columnar shape centered on the rotational center A2. The peripheral projections 44 are members having an arcuate pillar shape extending radially from the outer periphery of the columnar projection 43. The peripheral projections 44 are engageable against the stepped portions 633 of the drive-side coupling part 60 to function as driving force transmitted portions to which a rotary driving force of the drive section is to be transmitted from the stepped portions 633.

The top surface of the columnar projection 43 is provided with a recess 45 formed in a conical shape depressed from the top surface at the rotational center A2. The inside diameter of the recess 45 is set larger than the outside diameter of the semispherical projection 64 and, therefore, the semispherical projection 64 can fit into the recess 45. The above-described columnar projection 43, the peripheral projections 44, and the opening 38 define a space S2 surrounded by the columnar projection 43, the peripheral projections 44, and the inner periphery 39 of the opening 38.

Figure 6A:
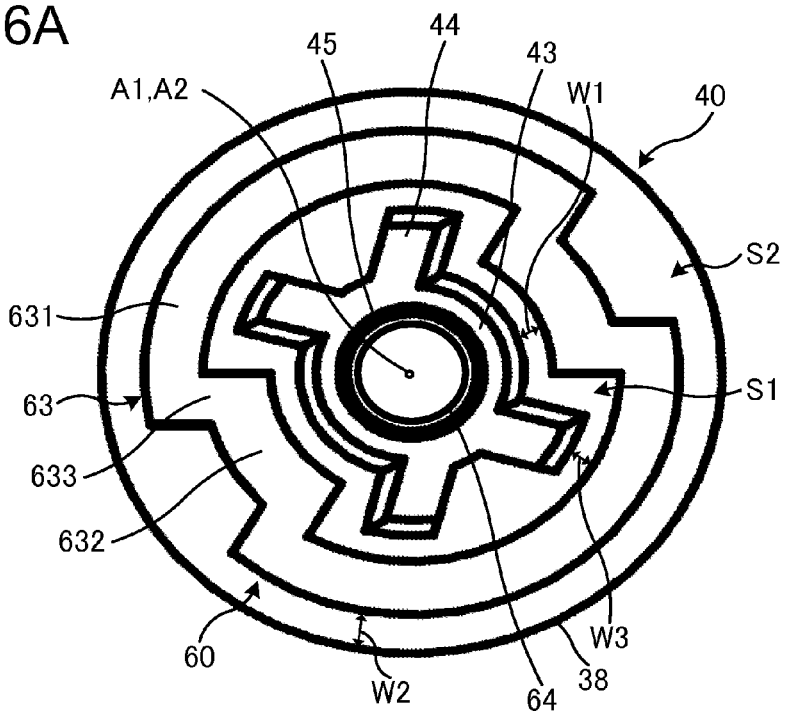
FIG. 6A is a view showing the positional relationship between the drive-side coupling part and the driven-side coupling part in an attached state where the developing device is attached to the apparatus body.

FIG. 6A is a view showing the positional relationship between the drive-side coupling part 60 and the driven-side coupling part 40 in the attached state where the developing device 16 is attached to the apparatus body 50.

The inside diameter D1 of the second projections 632 of the drive-side coupling part 60 is set larger than the outside diameter D2 of the columnar projection 43 of the driven-side coupling part 40. Furthermore, the inside diameter D3 of the first projections 631 of the drive-side coupling part 60 is set larger than the outside diameter D4 of the peripheral projections 44 of the driven-side coupling part 40. Therefore, as shown in FIG. 6A, the columnar projection 43 and the peripheral projections 44 of the driven-side coupling part 40 can fit into the space S1. In a state where the columnar projection 43 and the peripheral projections 44 fit in the space S1, a clearance W1 of (D1−D2) length, which is a difference between the inside diameter D1 and the outside diameter D2, is formed between the second projections 632 and the columnar projection 43. Furthermore, a clearance W3 of (D3−D4) length, which is a difference between the inside diameter D3 and the outside diameter D4, is formed between the first projections 631 and the peripheral projections 44.

Moreover, the inside diameter D5 of the opening 38 is set larger than the outside diameter D6 of the first projections 631 of the drive-side coupling part 60. Therefore, as shown in FIG. 6A, the cylindrical projection 63 of the drive-side coupling part 60 can fit into the space S2. In a state where the cylindrical projection 63 fits in the space S2, a clearance W2 of (D5−D6) length, which is a difference between the inside diameter D5 and the outside diameter D6, is formed between the opening 38 and the first projections 631. The length of the clearance W2, which is the difference between the inside diameter D5 and the outside diameter D6, is set equal to or larger than the length of the clearance W1, which is the difference between the inside diameter D1 and the outside diameter D2.

In addition, as described previously, since the inside diameter of the recess 45 is set larger than the outside diameter of the semispherical projection 64, the semispherical projection 64 can fit into the recess 45.

Meanwhile, developing devices 16 serving as removable units include different types of developing devices having different capabilities. Specifically, by changing the type of the developing device 16 attached to the apparatus body 50, image forming apparatuses 1 achieving various PPM capabilities or CPM capabilities can be produced. Combinations of apparatus body 50 and developing device 16 include appropriate combinations and inappropriate combinations. When a combination of an apparatus body 50 and a developing device 16 is appropriate, or in other words, a compatible developing device 16 is attached to the apparatus body 50, as shown in FIG. 6A, the drive-side coupling part 60 and the driven-side coupling part 40 completely mate together, wherein the columnar projection 43 and the peripheral projections 44 fit in the space S1 and the cylindrical projection 63 fits in the space S2. In other words, a state is reached where the semispherical projection 64 fits in the recess 45, the opening 38 surrounds the cylindrical projection 63, and the cylindrical projection 63 surrounds the columnar projection 43 and the peripheral projections 44. At this time, the rotational center A1 of the drive-side coupling part 60 coincides with the rotational center A2 of the driven-side coupling part 40 and the stepped portions 633 of the drive-side coupling part 60 engage against the peripheral projections 44 of the driven-side coupling part 40 in the direction of rotation of both the coupling parts 60, 40.

When in the above state the drive-side coupling part 60 is rotated by the drive section, the stepped portions 633 of the drive-side coupling part 60 press against the peripheral projections 44 of the driven-side coupling part 40 to rotate the driven-side coupling part 40. Thus, a rotary driving force is transferred at the pressing positions from the drive-side coupling part 60 to the driven-side coupling part 40. This rotary driving force is transmitted through gears or the like to the developing roller 31 and the agitating roller.

Figure 6B:
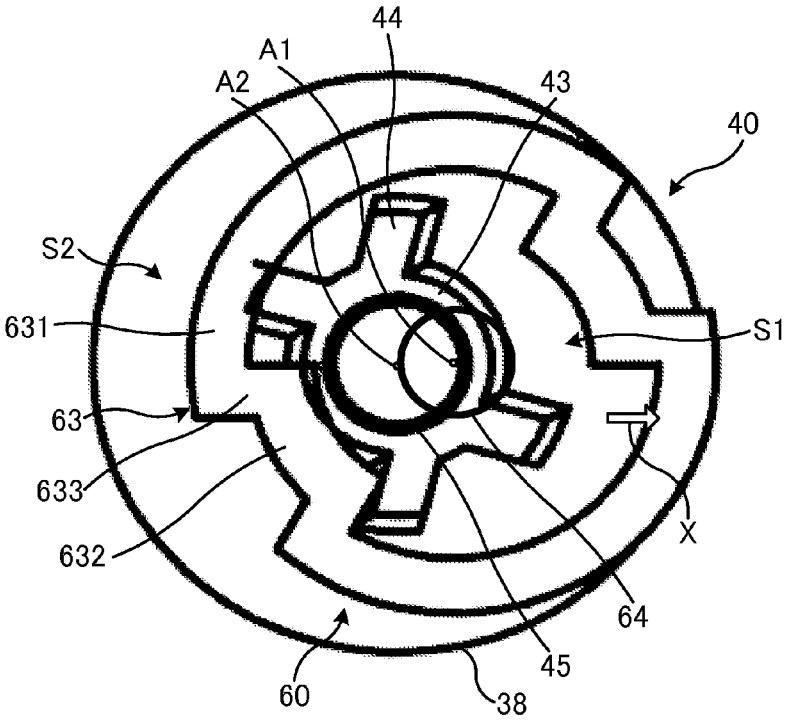
FIG. 6B is a view showing the positional relationship between the drive-side coupling part and the driven-side coupling part in a state where they are offset from each other.

FIG. 6B is a view showing the positional relationship between the drive-side coupling part 60 and the driven-side coupling part 40 in a state where they are offset from each other. When a combination of an apparatus body 50 and a developing device 16 is inappropriate, or in other words, an incompatible developing device 16 is attached to the apparatus body 50, for example, as shown in FIG. 6B, the drive-side coupling part 60 is attached to but a distance X offset from the driven-side coupling part 40. In this state, the drive-side coupling part 60 and the driven-side coupling part 40 cannot mate together. Specifically, as shown in FIG. 6B, the cylindrical projection 63 of the drive-side coupling part 60 gets on top of the columnar projection 43 and the peripheral projections 44. The cylindrical projection 63 of the drive-side coupling part 60 also gets on top of a portion of the cover part 37 surrounding the opening 38. Furthermore, the semispherical projection 64 of the drive-side coupling part 60 does not fit into the recess 45 in the driven-side coupling part 40. Thus, even when the drive-side coupling part 60 is rotated by the drive section, the stepped portions 633 of the drive-side coupling part 60 do not press against the peripheral projections 44 of the driven-side coupling part 40, so that the driven-side coupling part 40 does not rotate. Therefore, no rotary driving force is transferred from the drive-side coupling part 60 to the driven-side coupling part 40.

In a general image forming apparatus, when a combination of an apparatus body and a developing device is inappropriate, or in other words, an incompatible developing device is attached to the apparatus body, a driving force transmitting portion of a drive-side coupling part and a driving force transmitted portion of a driven-side coupling part may be partially engaged together even without complete fit between the drive-side coupling part and the driven-side coupling part, resulting in transmission of a driving force from the drive-side coupling part to the driven-side coupling part. If a driving force is transmitted without coincidence of the rotational center of the drive-side coupling part with the rotational center of the driven-side coupling part, the force is concentrated on certain members of the drive-side coupling part and the driven-side coupling part, so that these members may be broken.

Unlike the above, in the drive transmission mechanism according to the one embodiment of the present disclosure, when the combination of the apparatus body 50 and the developing device 16 is inappropriate and the drive-side coupling part 60 and the driven-side coupling part 40 are attached together a certain distance offset from each other, the drive-side coupling part 60 and the driven-side coupling part 40 do not mate together. Therefore, it is avoided that a driving force is transferred from the drive-side coupling part 60 to the driven-side coupling part 40 without coincidence of the rotational center of the drive-side coupling part 60 with the rotational center of the driven-side coupling part 40. Hence, it can be avoided that a force is concentrated on certain members of the drive-side coupling part 60 and the driven-side coupling part 40 to break these members.

Furthermore, in the drive transmission mechanism according to the one embodiment of the present disclosure, the length of the clearance W1 which is a difference between the inside diameter D1 and the outside diameter D2 is set equal to or smaller than the length of the clearance W2 which is a difference between the inside diameter D5 and the outside diameter D6 (maximum outside diameter of the cylindrical projection 63). Thus, when the developing device 16 is attached to the apparatus body 50 in a state where the offset distance X of the drive-side coupling part 60 from the driven-side coupling part 40 is larger than W2 ($X>W2\geq W1$), the cylindrical projection 63 of the drive-side coupling part 60 does not get on top of either the columnar projection 43 and the peripheral projections 44 of the driven-side coupling part 40 or a portion of the cover part 37 surrounding the opening 38 but gets on top of all these portions. As a result, the stepped portions 633 of the drive-side coupling part 60 do not press against the peripheral projections 44 of the driven-side coupling part 40, so that no driving force is transferred from the drive-side coupling part 60 to the driven-side coupling part 40.

The present disclosure is not limited to the structure and configuration of the above embodiment and can be modified in various ways.

For example, although in the above embodiment the description has been given of the case where the drive transmission mechanism is applied to the developing device 16 serving as a removable unit, the present disclosure is not necessarily limited to this. The above drive transmission mechanism may be applied to other process units, such as a photoconductor device.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A drive transmission mechanism comprising:

a drive unit including a drive section and a drive-side coupling part to which a rotary driving force of the drive section is to be transmitted; and a removable unit attachable to and removable from the drive unit, wherein the removable unit includes a cover part having a circular opening formed in a portion of an outside surface thereof, a driven-side coupling part provided within the opening and mating with the drive-side coupling part in an attached state where the removable unit is attached to the drive unit, and a driven section capable of being driven by the rotary driving force transmitted from the drive-side coupling part to the driven-side coupling part, wherein the drive-side coupling part comprises: a first base including a first opposed surface facing the driven-side coupling part in the attached state; a semispherical projection raised from the first opposed surface at a rotational center of the drive-side coupling part; and a cylindrical projection being integrally formed with a first projection of an arcuate pillar shape centered on the rotational center of the drive-side coupling part, a second projection of an arcuate pillar shape having a shorter inside diameter than an inside diameter of the first projection, and a stepped portion extending in a radial direction and connecting the first projection and the second projection, the driven-side coupling part comprises: a second base including a second opposed surface facing the drive-side coupling part in the attached state; a columnar projection raised from the second opposed surface at a rotational center of the driven-side coupling part; a peripheral projection raised radially from an outer periphery of the columnar projection; and a recess depressed from a top surface of the columnar projection at the rotational center of the driven-side coupling part, and wherein when in the attached state the semispherical projection fits in the recess, the opening surrounds the cylindrical projection, and the cylindrical projection surrounds the columnar projection and the peripheral projection, the rotational center of the drive-side coupling part coincides with the rotational center of the driven-side coupling part and the stepped portion engages against the peripheral projection in a direction of rotation of the drive-side coupling part and the driven-side coupling part, resulting in a state where a rotary driving force is transmittable from the drive-side coupling part to the driven-side coupling part.

2. The drive transmission mechanism according to claim 1, wherein a difference between an inside diameter of the second projection and an outside diameter of the columnar projection is set equal to or smaller than a difference between an inside diameter of the opening and a maximum outside diameter of the cylindrical projection.

3. The drive transmission mechanism according to claim 1, wherein the cylindrical projection of the drive-side coupling part is provided so that a plurality of the first projections and a plurality of the second projection are alternately arranged, and a plurality of the peripheral projections are provided on an outer periphery of the columnar projection of the driven-side coupling part.

4. An image forming apparatus comprising the drive transmission mechanism according to claim 1, wherein the removable unit is a developing device including as the driven sections an agitating roller capable of agitating a developer and a developing roller capable of supplying the developer to an image carrier.

* * * * *